US006540201B1

(12) United States Patent
Gagnon et al.

(10) Patent No.: US 6,540,201 B1
(45) Date of Patent: Apr. 1, 2003

(54) TILT-UP CONCRETE PANEL FORMING SYSTEM

(75) Inventors: Richard B. Gagnon, San Clemente, CA (US); James Steven Lutes, Dana Point, CA (US)

(73) Assignee: White Cap Industries Incorporated, San Juan Capistrano, CA (US)

( * ) Notice: Subject to any disclaimer, the term of this patent is extended or adjusted under 35 U.S.C. 154(b) by 0 days.

(21) Appl. No.: 09/794,829

(22) Filed: Feb. 26, 2001

(51) Int. Cl.[7] ..... E04G 11/00

(52) U.S. Cl. ..... 249/139; 249/189; 249/210; 249/219.1; 249/18

(58) Field of Search ..... 249/2, 4, 18, 133, 249/139, 210, 219.1, 189; 52/127.2, 699

(56) References Cited

U.S. PATENT DOCUMENTS

| | | | | |
|---|---|---|---|---|
| 2,711,573 A | | 6/1955 | Bliss | |
| 2,940,718 A | | 6/1960 | Beal | |
| 3,295,474 A | | 1/1967 | Ornstein | |
| 3,797,800 A | | 3/1974 | Loy | |
| 4,068,427 A | | 1/1978 | Camardo | |
| 4,101,111 A | | 7/1978 | Bishhop | |
| 4,339,106 A | | 7/1982 | Navarro | |
| 4,393,568 A | | 7/1983 | Navarro | |
| 4,659,057 A | | 4/1987 | Felter | |
| 4,846,437 A | | 7/1989 | Fitzgerald | |
| 4,872,634 A | | 10/1989 | Gillaspy et al. | |
| 4,944,664 A | | 7/1990 | Allred | |
| 4,996,770 A | | 3/1991 | McCracken | |
| 5,076,536 A | | 12/1991 | Fitzgerald | |
| 5,096,155 A | | 3/1992 | Fitzgerald | |
| 5,205,942 A | * | 4/1993 | Fitzgerald | 249/14 |
| 5,343,667 A | | 9/1994 | Peden | |
| 5,481,836 A | | 1/1996 | Miller et al. | |
| 5,522,579 A | | 6/1996 | Röck | |
| 5,609,005 A | | 3/1997 | Schierloh et al. | |
| 5,615,854 A | | 4/1997 | Nomura et al. | |
| 5,622,021 A | | 4/1997 | Bookout | |
| 5,817,247 A | | 10/1998 | Colatruglio | |
| 5,843,327 A | | 12/1998 | Lindgren | |

* cited by examiner

*Primary Examiner*—Jan H. Silbaugh
*Assistant Examiner*—Donald Heckenberg

(57) ABSTRACT

A system for tilt-up concrete panel forming for use on a casting surface comprising an elongated base strip having an elongated groove in an upper surface, having a chamfered edge, and having a bottom surface adapted to be adhesively attached to the casting surface. The base strip has a support edge on the upper surface for receiving and supporting an elongated wooden panel form. A plurality of brackets each have a bottom section for mating with the elongated groove of the base strip at spaced intervals along the base strip, and the brackets further including a support section for supporting a side of the panel forms. Suitable clips can be added to the support sections of the brackets to impart a camber to an end of the concrete panel being formed.

31 Claims, 4 Drawing Sheets

FIG. 1
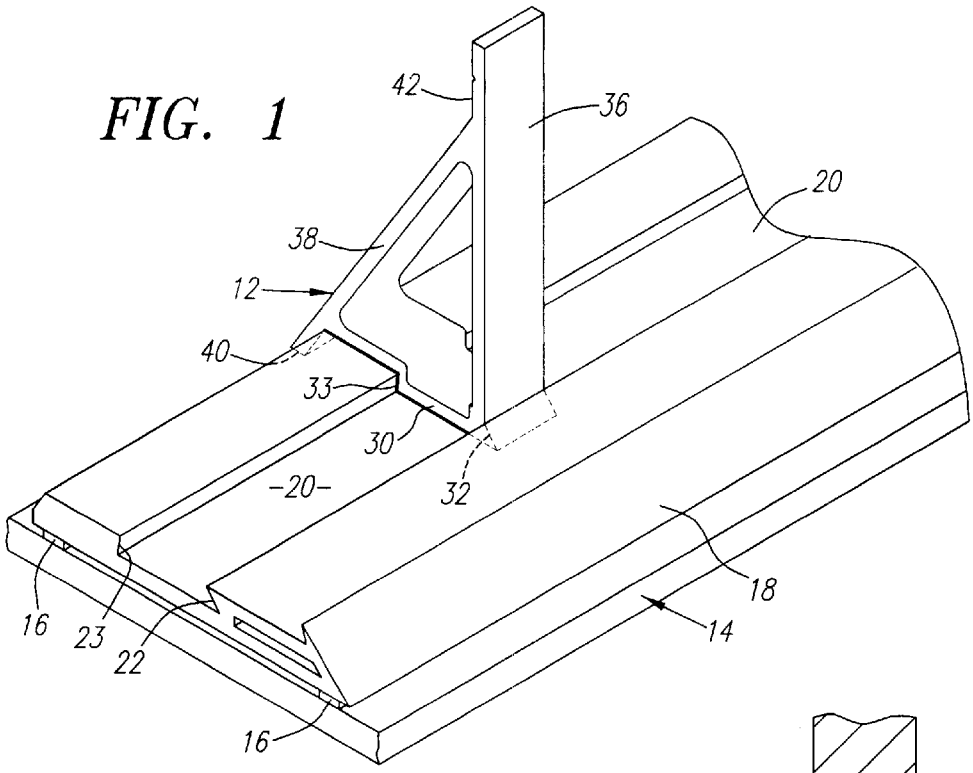
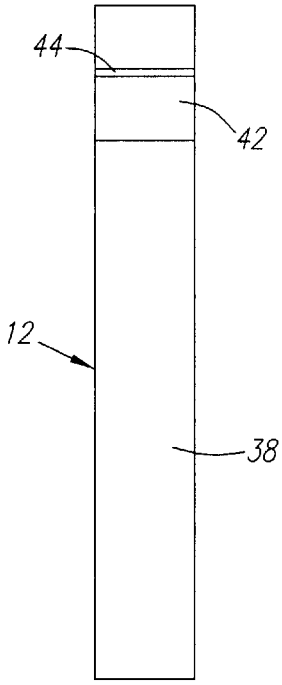
FIG. 3
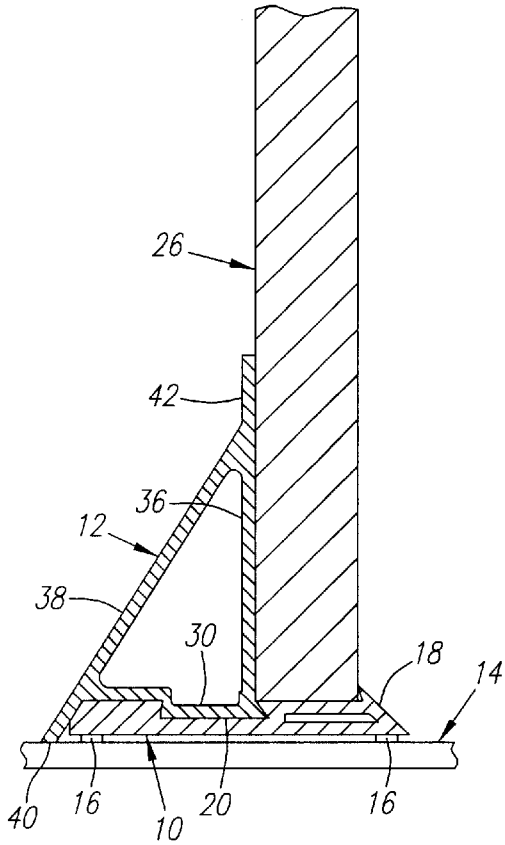
FIG. 2

TILT-UP CONCRETE PANEL FORMING SYSTEM

The present invention relates to the manufacture of tilt-up concrete panels, and more particularly to a system of components for facilitating casting of panels on a casting surface without the need for penetrations, as by nails in drilled holes, of the casting surface as is common in traditional panel forming methods.

BACKGROUND

It is well known in the process of manufacturing concrete walls or wall sections to form them on a substantially flat, hard surface such as a concrete floor, and subsequently to tilt up the hardened and cured concrete section to form a wall or wall section. It is common practice in the construction industry to pour several walls or wall sections of a building on a previously poured and hardened floor of the building under construction. In doing so, a suitably large area of the floor is formed or fenced off by a plurality of wooden forms which define the edges of the final wall or section. These forms are attached to the floor so as to prevent dislocation or movement, particularly in a lateral direction. The surface of the floor is provided with a suitable bond-beaker material in order to prevent the newly formed section from adhering to the floor. A concrete mix is then poured into the area fenced off by the wooden forms. After curing and hardening of the newly poured concrete, the wooden forms are removed and the concrete wall section is lifted off the floor by a crane or other suitable device to complete a wall section of the building.

The usual practice after.the concrete floor or foundation has been poured and cured is that a wooden form is constructed on the floor into which concrete for the wall panels can be poured. The wall form: is a wooden plank, such as a 2×10 plank and which is supported by wooden brackets spaced along the form at, for example, 2 foot intervals, and nailed to the concrete floor. This type of installation involves a substantial amount of manual labor. In addition, after the concrete panel is cast into the form area, the forms and base and whatever brace members are used must be removed and, importantly, the nail holes in the floor need to be patched. This involves additional manual labor. Presently, one may end up with 1,000–10,000 such holes in the concrete floor which must be patched.

Also, a chamfer strip is added inside of the resulting form adjacent the floor and forms to suitably chamfer the edge of the concrete wall panel. If this is not done, the edge tends to crumble after the wall: is completed.

Example prior art systems can be found in U.S. Pat. No. 4,393,568, U.S. Pat. No. 4,101,111 and U.S. Pat. No. 4,042,205.

SUMMARY OF THE INVENTION

The present invention eliminates the need for nailing wooden forms to a concrete or other floor or base, and the need for adding a chamfer strip. This is accomplished by providing an elongated base track or strip and brackets attached thereto to support a wooden form between.the base and bracket. Preferably, the bracket and strip are configured so that the bracket can merely snap into a channel or longitudinal slot in the base track. The bottom of the base track has secured thereto one or more strips of two sided adhesive along the whole length of the base track to adhere the base track to the concrete floor onto which the wall section is to be poured. The base track itself has a chamfered edge for providing a chamfer on an edge of the concrete wall. This system eliminates the need for penetrating the floor with nails or other fasteners and thus also eliminates the need to patch the resulting holes. Furthermore, no separate chamfer strip is needed. Also, the components may be reusable.

In a presently preferred embodiment, a base strip and bracket are provided along with a batter clip attachable to the upper end of the bracket so as to position the wooden form at a slight angle or cant the form, so as to provide a camber at one end or side of a concrete panel which will become the top or roof line of a wall. The batter clip pushes the form away from the bracket by a small angle to create the camber. The camber created by this technique is an important feature to reduce the problem when dust collects at the top of a panel used as a wall, at the roof line. Because of this, the dust and dirt that collects on the top can work itself down inside the wall rather than down the outside. This is advantageous because if the dust works down the outside of the wall and it rains, the outside of the wall is streaked with the moist dust and dirt.

Accordingly, it is an object of the present invention to provide an improved concrete panel forming system.

Another feature of the present invention is to provide components and a system for forming tilt-up concrete panels without requiring penetration of the base surface by fasteners such as nails and the like.

Another feature of the present invention is to provide a concrete panel forming system comprising an elongated base track and support brackets which snap into a channel in the base track for supporting a wooden form.

Another feature of the present invention is a tilt-up concrete panel forming system incorporating an integral chamfer strip.

BRIEF DESCRIPTION OF DRAWINGS

These and other objects and features of the present invention will become better understood through a consideration of the following description, taken in conjunction with the drawings in which:

FIG. 1 is a perspective view of the present concrete panel forming system showing a base track and bracket thereof.

FIG. 2 is an end cross-section of the system of FIG. 1 taken along a line 2—2 but further showing the position and support for a wooden form, FIG. 3 is an end view of the bracket of the system of FIGS. 1 and 2.

DETAILED DESCRIPTION

Figure 4:
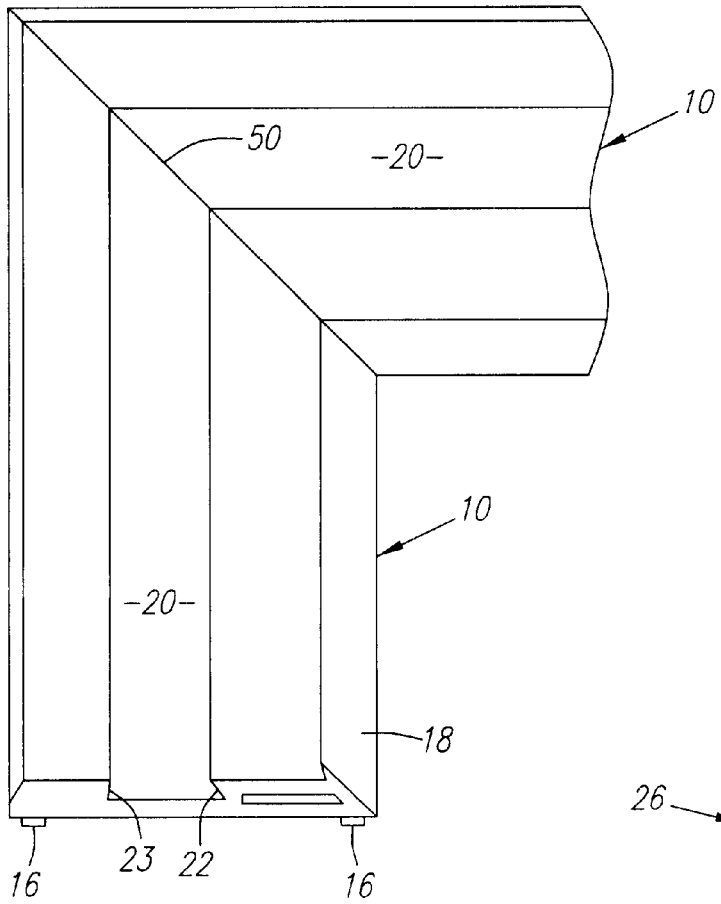
FIG. 4 is a view of a pre-made corner section of base strips.

Turning now to the drawings, the present tilt up concrete panel forming system comprises a base track or strip 10 and a bracket 12. The base strip 10 typically is 5' or 10' in length and is placed on.a concrete floor 14. The strips 10 are laid end-to-end as necessary depending on the length and width of the final wall. The base strips 10 are secured to the concrete floor 14 by one or more double sided adhesive strips 16 after the floor is cleaned, such as by vacuuming or sweeping and then picking up dust with a damp rag, preferably before any bond breaker is applied to the concrete floor. The strips 16 run the length of the base strip 10.

The base strip 10 includes an angled side 18 which provides the function of a separate chamfer strip as used in the prior art. The strip 10 also includes a longitudinal slot 20 which has angled sides 22 and 23 as seen in FIGS. 1 and 2 into which the bracket 12 is inserted as will be discussed subsequently. Preferably, the base strip 10 is formed of a suitable plastic material which has some resiliency to facilitate the base 30 of the bracket 12 snapping into the slot 20. A plurality of the brackets 12 are inserted into the base strip, such as at 2 foot intervals to suitably support a wooden form 26 (note FIG. 2).

Turning now to more details of the bracket 12, the same includes the base 30 having angled walls 32 and 33 to fit or snap into the slot 20 of the base strip 10 adjacent to and mate with the angled walls 22 and 23 of the strip 10. The bracket 12 further includes an upstanding support 36 which "backs up" the wooden form 26. The bracket 12 has an angle brace 38, the lower end 40 of which rests on the concrete floor 14. The upper end 42 of the support 36 provides an area through which a suitable screw fastener (not shown) can be inserted as through a groove 44 as seen in the end view of the brace 12 in FIG. 3 to securely affix the bracket 12 to the wooden form 26. The wooden form typically is a 2×6, 2×8, or the like. Preferably the brackets 12 are made in different sizes for different applications, such as for different thickness wall panels. The brackets can be formed from extruded plastic or aluminum and cut into sections to form the same or they may be injection molded of plastic.

FIG. 4 illustrates a premade corner for the base strips 10. As can be seen, two short lengths (e.g., 1 foot), strips 10 are cut at a 45° angle as seen at 50 and glued together by suitable adhesive, such as PVC glue. This arrangement provides a premade corner to simplify installation of the present forming system.

As will be appreciated, the present system provides a relatively simple way of setting up concrete forms by merely laying down the base strips 10 which are secured to the floor 14 (after suitable preparation of the floor, e.g., to remove dust, etc. as noted above), inserting a plurality of the brackets 12 into the longitudinal groove 20 of the base strips 10, and the wooden forms 26 are placed on the strips and secured at a groove 44 (FIG. 3) to the forms 26. This system simplifies and facilitates setting up the forms, does not require the numerous nailing and nail holes thereby minimizing the labor for both installation and removal. Additionally, the components, namely the base strips 10 and brackets 12, may be reusable although new adhesive strips 16 may be needed.

The present system provides a complete tilt-up concrete forming system that eliminates the need for penetrations in the casting surface, i.e., the floor or slab 14, as is common in traditional panel forming methods. This system increases productivity and simplifies panel forming operations, and eliminates the need to patch thousands of holes which in the prior art systems are drilled in the casting surface when using traditional panel forming methods. The base track or strip 10 incorporates the continuous chamfered edge 18 thereby eliminating the need to use a separate chamfer strip and the need to nail on a separate chamfer strip after the panel forms are erected. The base track 10 can be formed from plastic material which eliminates the usual dusting effect from a chamfered edge of wood which contains natural sugars that retard concrete curing. The use of two sided adhesive strips or tape 16 to adhere the base track 10 to the casting surface 14 provides continuous support along the entire length of the panel forms to resist pressure from the concrete during the placing operation. The base tracks and brackets may be reusable, and the brackets easily snap into the base track. The angled surfaces 32 and 33 of the bracket 12 and the angled surfaces 22 and 23 of the longitudinal groove 20 of the base strip 10 prevent uplift of panel forms during the concrete placing operation. The angled rear brace 38 of the brackets 12 extend beyond the base strip 10 at 40 to contact the casting surface 14 directly to keep the form panel plumb. The upper end 42 of the bracket 12 preferably is provided with the groove 44 to facilitate alignment and guiding of a self-tapping screw to attach the bracket 12 to the wooden form 26. Only one self-tapping screw per form bracket 12 is needed to hold the panel form 26 in place. The use of the groove for this purpose reduces labor costs which would be required if a hole had to be drilled for a nail or screw. The brackets 12 can be placed at any point along the entire length of the base strip 10 as necessary to support the form 26, usually several feet apart. The brackets 12 can be manufactured in different sizes for varying concrete panel thickness.

Figure 5:
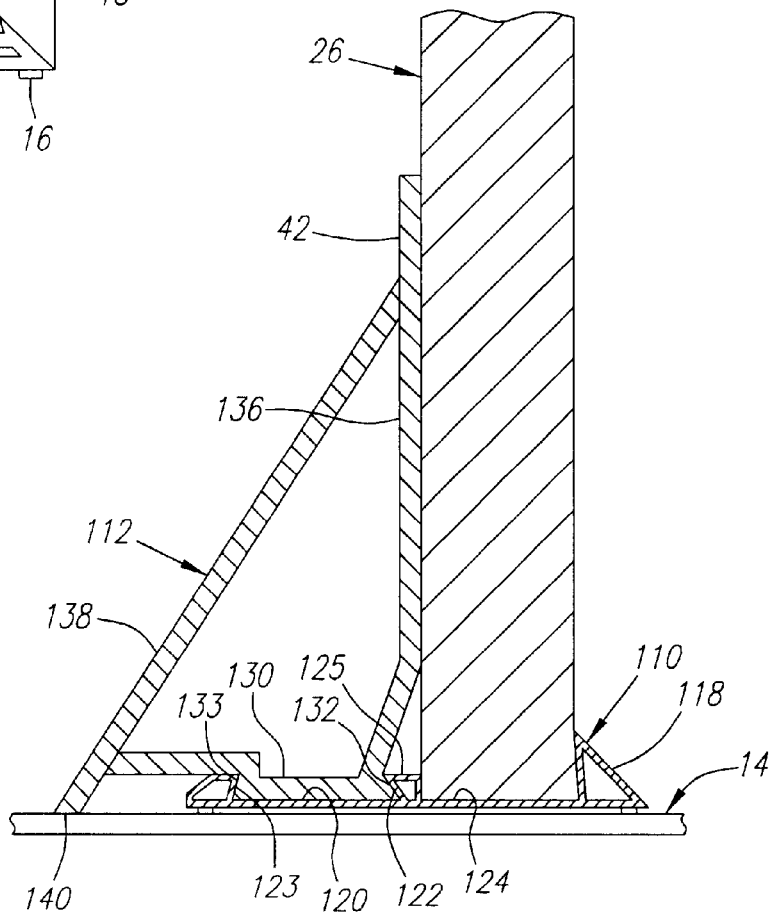
FIG. 5 illustrates another embodiment of a base strip and bracket.

Turning now to FIG. 5, the same illustrates a second embodiment which may be preferred for some applications. This embodiment is similar to that of FIGS. 1 through 3, but the base strip 110 has a deeper cavity or opening 124 so that the form 26 fits down further into the base strip. The bracket 112 is similar to the bracket 38 with a base section 130 having angled edges 132 and 133 to fit within the groove 120 and angled edges thereof 122 and 123. The bracket 112 further includes an offset angled section 144 which allows the upstanding support 136 to properly engage and back-up a wooden form 26. This is needed because of the offset occasioned by section 125 of the base strip 110. As with the embodiment of FIGS. 1 through 4, this embodiment of a base strip and bracket has like features and benefits.

Turning now to the embodiment of FIGS. 6 through 9, and which is believed to be a preferred embodiment, the components are similar to those of the previous two embodiments but with some important differences. This embodiment includes a base strip 210 and bracket 212. The base strip 210 is simpler in that a slot or groove 220 is in the form of a U-shaped channel (note particularly FIG. 9) for receiving an L-shaped foot 230 of the bracket 212. The base strip 210 includes a cavity 224 for receiving the lower end of the form 226 (not shown in FIG. 6, but note FIG. 9). The base strip also includes an angled side 218 which provides the function of a separate chamfer strip as previously discussed.

Figure 6:
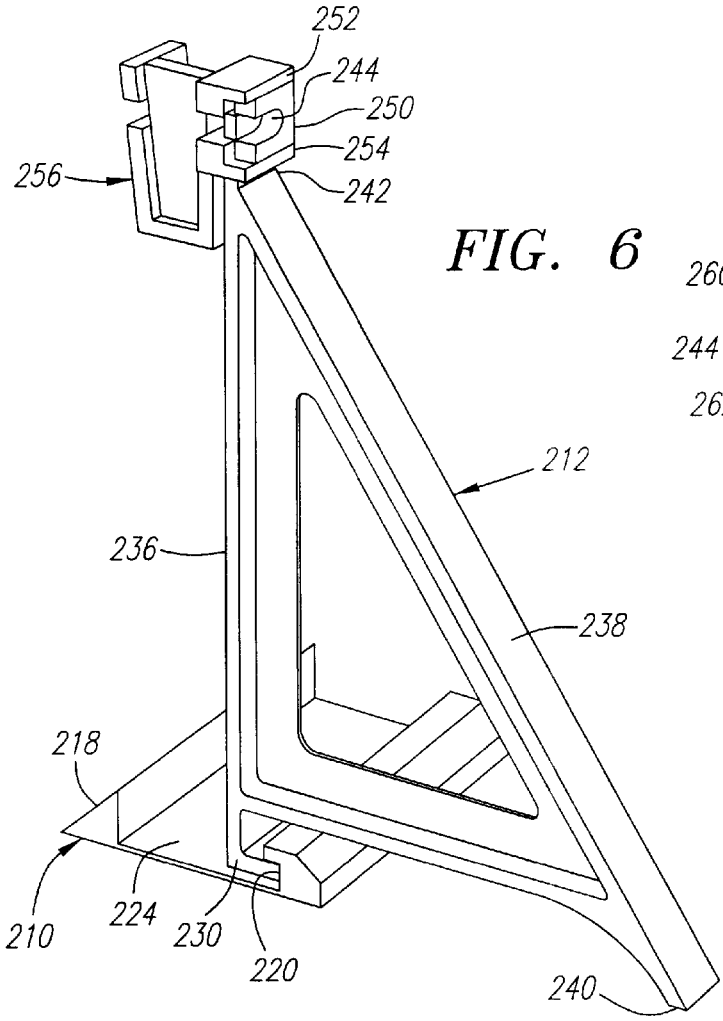
FIG. 6 illustrates another and preferred embodiment of a base strip and bracket.
Figure 7:
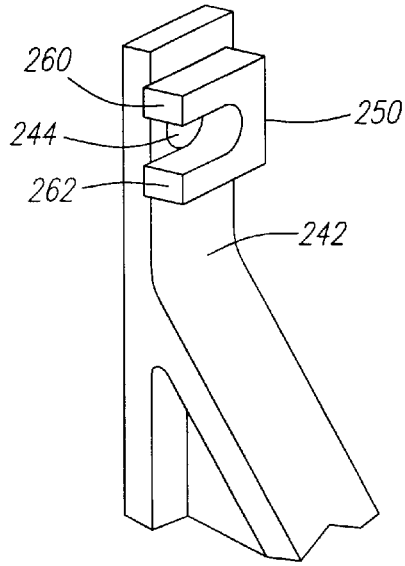
FIG. 7 is a detailed view of the upper end of the bracket of FIG. 6.
Figure 8:
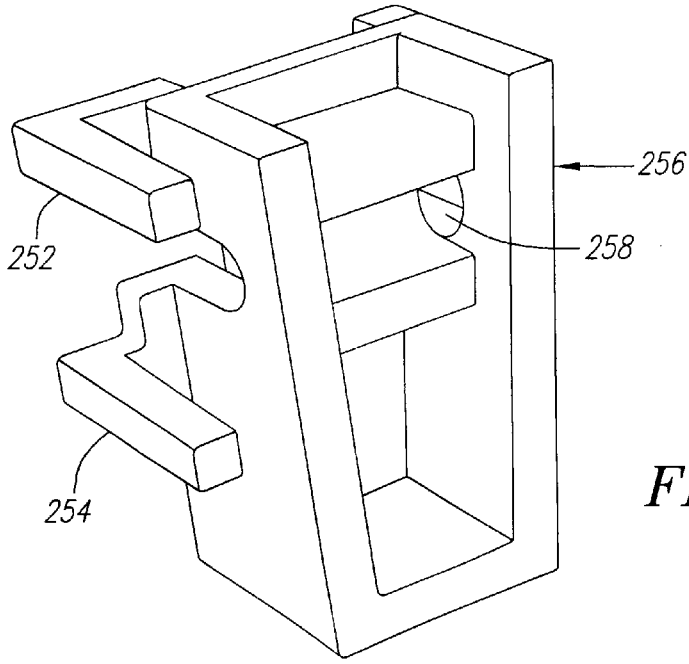
FIG. 8 is a perspective view of a batter clip used with the bracket of FIG. 6 (and also shown in FIG. 6)

The bracket 212 includes an upstanding support 236 and an angle brace 238 which has a foot 240, all very similar to those of the preceding embodiments; however, in this embodiment the bracket 212 is of a T-beam shape as can best be seen in FIG. 6. The upper end 242 of the bracket 212 has an aperture 244 (note also the detail of FIG. 7). Adjacent the opening 244 at the upper end 242 of the bracket 212 is a U-shaped boss 250 which is configured to receive and couple with U-shaped fingers 252 and 254 of a batter clip 256. The batter clip 256 slides onto the upper end 242 of the bracket 212 around the boss 250 and engages fingers 260 and 262 of the end 242 of the bracket 212 to firmly support the batter clip 256 on the upper end 242 of the bracket 212. The clip 256 also has a through aperture 258 (FIG. 8) as a continuation of the aperture 244 in the upper end 242 of the bracket 212 to allow the upper end 242 of the bracket 212 to be firmly attached to the wooden form (note FIG. 9) by a nail or screw.

The main purpose of the batter clip 256 is to hold the form 226 outwardly at an angle as seen in FIG. 9 to cause a camber to be provided to the edge of the concrete panel when this edge is to be the top of a concrete panel at a roof line for the purposes as previously described. That is, the camber or slight angle is provided on the edge 264 of the concrete panel 265 by the form 226 so that when dust collects on the cambered top (260) of the panel the dust can fall to the inside of the building rather than the outside of the building to minimize dirt streaking the outside wall. An exemplary angle imparted to the form by the clip 256 is approximately 7 degrees, although different angles can be provided as desired.

Figure 9A:
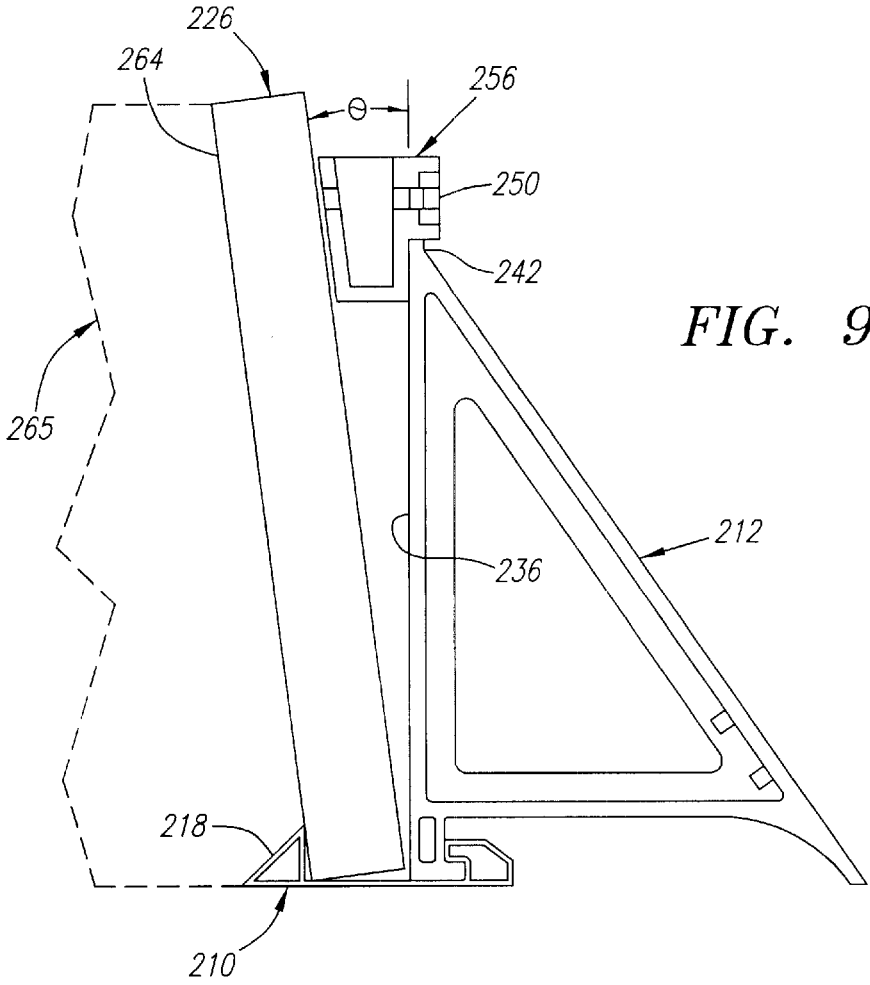
FIG. 9*a* is a cross-sectional diagrammatic end view of the base strip and bracket of FIG. 6 and also illustrating a wooden form and the manner in which the batter clip cants the wooden form.
Figure 9B:
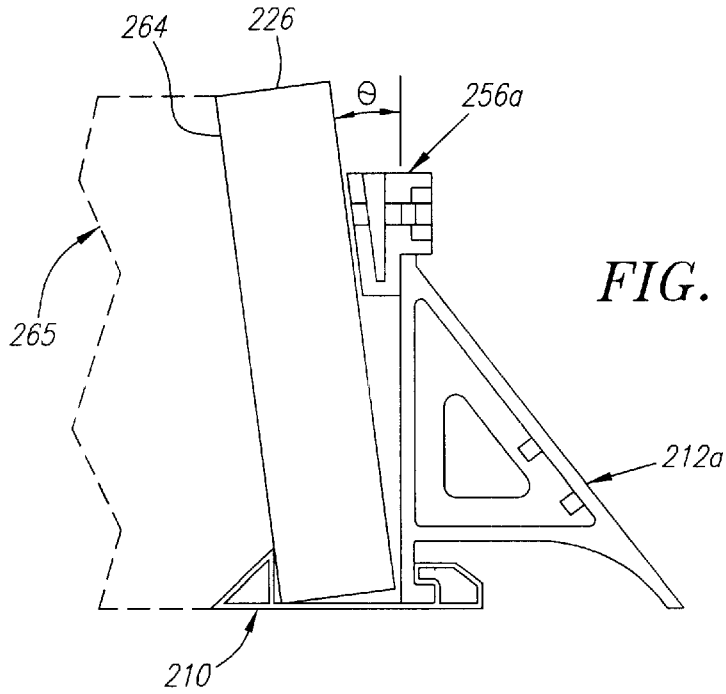
FIG. 9*b* illustrates a smaller version of the bracket.

FIG. 9*a* shows the bracket 212, clip 256 and strip 210 of FIGS. FIG. 9*b* shows a smaller version of a bracket 212*a*, clip 256*a* and the strip 210. An example width at the base of the bracket 212 is 5.44 inches (and 3.345 inches on bracket 212*a*) and height of 8.76 inches (and 5.263 inches for 212*a*).

Each of the components in the embodiment of FIGS. 6 through 9 can be injection molded of a suitable material such as polypropylene, although the components can be either plastic or metal as may be desired.

While embodiments of the present invention as been shown and described, various modifications may be made without departing from the scope of the present invention, and all such modifications and equivalents are intended to be covered.

What is claimed is:

1. A system for tilt-up concrete panel forming for use on a concrete casting surface comprising an elongated base strip having an elongated groove in an upper surface, having a chamfered edge, and having a bottom surface adapted to receive an adhesive along the length of the bottom surface for securing the base strip to the casting surface, the base strip having a support edge on the upper surface adjacent an upper end of the chamfered edge for receiving an elongated panel form, and a plurality of brackets each having a bottom section with at least one inclined edge for enabling the brackets to snap into the elongated groove of the base strip at spaced intervals along the base strip, the brackets further including an upstanding support section for supporting a side of a panel form, and the brackets including an angled brace fixed to the upstanding section and extending downwardly at an angle and having a bottom for engaging the casting surface.

2. A system as in claim 1 including an adhesive on the bottom surface comprising strips of double sided tape.

3. A system as in claim 1 including a panel form comprising a wooden form.

4. A system as in claim 1 wherein the base strip is formed of plastic.

5. A system as in claim 1 wherein the brackets are formed of metal or plastic.

6. A system as in claim 5 wherein each bracket is a unitary piece of metal or plastic.

7. A system as in claim 6 wherein the brackets are formed of extruded aluminum or plastic and cut into separate brackets or formed of injected molded plastic.

8. A system as in claim 1 further including a batter clip attachable to the upper end of each bracket to support a side of the panel form at a small angle to thereby cause a camber to be formed along the edge of the concrete panel.

9. A system as in claim 8 where the angle is approximately 7 degrees.

10. A system for tilt-up concrete panel forming for use on a concrete casting surface comprising an elongated base strip formed of plastic having an elongated groove in an upper surface, having a chamfered edge, and having a bottom surface adapted to receive an adhesive along the length of the bottom surface for securing the base strip to the casting surface, the base strip having a support edge on the upper surface adjacent an upper end of the chamfered edge for receiving an elongated wooden panel form, and a plurality of metal or plastic brackets each having a bottom section with at least one inclined edge for enabling the brackets to snap into the elongated groove of the base strip at spaced intervals along the base strip, the brackets further including an upstanding support section for supporting a side of a panel form, and the brackets including an angled brace fixed to the upstanding section and extending downwardly at an angle and having a bottom for engaging the casting surface, the upper end of the support section of each bracket having a groove for facilitating attachment to the panel form.

11. A system as in claim 10 wherein each bracket is a unitary piece of metal or plastic.

12. A system as in claim 11 wherein the brackets are formed of extruded aluminum and cut in to separate brackets or injection molded.

13. A system as in claim 10 further including a batter clip attachable to the upper end of each bracket to support a side of the panel form at a small angle to thereby cause a camber to be formed along the edge of the concrete panel.

14. A system as in claim 13 where the angle is approximately 7 degrees.

15. A tilt-up concrete panel forming device for use on a casting surface comprising a plurality of elongated base strips each having an elongated groove in an upper surface, having a chamfered edge, and having a bottom surface adapted to receive an adhesive along the length of the bottom surface for securing the base strips to the casting surface, the base strips each having a support edge on the upper surface adjacent an upper end of the chamfered edge for receiving an elongated panel form, and a plurality of brackets each having a bottom section with at least one inclined edge for enabling the brackets to snap into the elongated grooves of the base strips at spaced intervals along the base strips, the brackets each further including an upstanding support section for supporting the side of the panel form, and the brackets each including an angled brace fixed to the upstanding section and extending downwardly at an angle and having a bottom for engaging the casting surface.

16. A device as in claim 15 including a panel form comprising strips of double sided tape.

17. A device as in claim 15 including a panel form comprising a wooden form.

18. A device as in claim 15 wherein the base strip is formed of plastic.

19. A device as in claim 15 wherein the brackets are formed of metal or plastic.

20. A device as in claim 15 wherein each bracket is a unitary piece of metal or plastic.

21. A device as in claim 20 wherein the brackets are formed of extruded aluminum and cut into separate brackets or injection molded.

22. A device as in claim 15 wherein each bracket has a groove near the upper end of the support section for facilitating fastening each bracket to a panel form.

23. A system as in claim 15 further including a batter clip attachable to the upper end of each bracket to support a side of the panel form at a small angle to thereby cause a camber to be formed along the edge of the concrete panel.

24. A system as in claim 23 where the angle is approximately 7 degrees.

25. A system for tilt-up concrete panel forming for use on a concrete casting surface comprising an elongated base strip having an elongated groove in an upper surface, and having a bottom surface adapted to receive an adhesive along the length of the bottom surface for securing the base strip to the casting surface, the base strip having a support edge on the upper surface for receiving an elongated panel form, and a plurality of brackets each having a bottom section with at least one inclined edge for enabling the brackets to snap into the elongated groove of the base strip at spaced intervals along the base strip, the brackets further including an upstanding support section for supporting a side of a panel form, and the brackets including an angled brace fixed to the upstanding section and extending downwardly at an angle and having a bottom for engaging the casting surface.

26. A system as in claim 25 wherein the base strip has a chamfered edge.

27. A system as in claim 25 further including a batter clip attachable to the upper end of each bracket to support a side of the panel form at a small angle to thereby cause a camber to be formed along the edge of the concrete panel.

28. A system as in claim 1 wherein the casting surface is a concrete floor or slab.

29. A system as in claim 10 wherein the casting surface is a concrete floor or slab.

30. A system as in claim 15 wherein the casting surface is a concrete floor or slab.

31. A system as in claim 25 wherein the casting surface is a concrete floor or slab.

* * * * *